US012313360B2

(12) United States Patent
Sjögren

(10) Patent No.: US 12,313,360 B2
(45) Date of Patent: May 27, 2025

(54) SUPPRESSOR FOR A FIREARM

(71) Applicant: SILENT STEEL OY, Hietanen (FI)

(72) Inventor: Harri Sjögren, Hietanen (FI)

(73) Assignee: SILENT STEEL OY, Hietanen (FI)

( * ) Notice: Subject to any disclaimer, the term of this patent is extended or adjusted under 35 U.S.C. 154(b) by 115 days.

(21) Appl. No.: 18/248,480

(22) PCT Filed: Oct. 15, 2021

(86) PCT No.: PCT/FI2021/050687
§ 371 (c)(1),
(2) Date: Apr. 10, 2023

(87) PCT Pub. No.: WO2022/079358
PCT Pub. Date: Apr. 21, 2022

(65) Prior Publication Data

US 2023/0392893 A1 Dec. 7, 2023

(30) Foreign Application Priority Data

Oct. 15, 2020 (FI) ..... 20206017

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 1,017,003 | A * | 2/1912 | Kenney | F41A 21/30 89/14.4 |
| 6,079,311 | A * | 6/2000 | O'Quinn | F41A 21/30 89/14.4 |
| 8,820,473 | B1 * | 9/2014 | White | F41A 21/34 89/14.4 |
| 9,500,427 | B1 * | 11/2016 | Larue | F41A 21/30 |
| 10,393,463 | B1 * | 8/2019 | Sanders | F41A 21/34 |
| 11,506,463 | B1 * | 11/2022 | Kunsky | F41A 21/30 |

(Continued)

FOREIGN PATENT DOCUMENTS

| | | | |
|---|---|---|---|
| DE | 102016000429 | A1 | 7/2017 |
| GB | 356224 | A | 8/1931 |

(Continued)

OTHER PUBLICATIONS

International Search Report and Written Opinion in Application No. PCT/FI2021/050687, mailed Jan. 11, 2022, 13p.

(Continued)

*Primary Examiner* — Samir Abdosh
(74) *Attorney, Agent, or Firm* — Meunier Carlin & Curfman LLC

(57) ABSTRACT

A firearm suppressor with a simple, light, easy-to-manufacture and easy-to clean is provided. In the device and solution provided, the propellant gas is not stopped inside the suppressor but directed to flow in a controlled manner through the suppressor and out of the suppressor. This significantly reduces the heating of the suppressor, the fouling of the firearm by propellant gases and gunpowder firing residues. Moreover, the solution reduces contact of the propellant gases with the shooter's face.

15 Claims, 3 Drawing Sheets

(56) References Cited

U.S. PATENT DOCUMENTS

| | | | | |
|---|---|---|---|---|
| 11,680,764 | B1 * | 6/2023 | Bray | F41A 21/32<br>181/223 |
| 2017/0006771 | A1 * | 1/2017 | Henry | A01C 23/007 |
| 2019/0186860 | A1 * | 6/2019 | Ellison | F41A 21/30 |
| 2020/0109907 | A1 * | 4/2020 | Klett | F41A 21/30 |
| 2020/0232741 | A1 * | 7/2020 | Hood, II | F41A 21/30 |
| 2020/0248980 | A1 * | 8/2020 | Bragais | F41A 21/32 |
| 2022/0057160 | A1 * | 2/2022 | Johns | F41A 21/30 |
| 2023/0392893 | A1 * | 12/2023 | Sjögren | F41A 21/30 |

FOREIGN PATENT DOCUMENTS

| | | | |
|---|---|---|---|
| RU | 2709294 | C1 | 12/2019 |
| WO | 2012045119 | A1 | 4/2012 |
| WO | 2020111950 | A1 | 6/2020 |

OTHER PUBLICATIONS

Search Report in Finnish Application No. 20206017, dated Apr. 30, 2021. 2p.

Supplementary Search Report for European Application No. 21879594 dated Sep. 19, 2024.

* cited by examiner

SUPPRESSOR FOR A FIREARM

CROSS REFERENCES

This application is a U.S. national stage application of international patent application number PCT/FI2021/050687 filed on Oct. 15, 2021, claiming priority to Finnish national application number FI20206017 filed on Oct. 15, 2020.

TECHNICAL FIELD

The application is generally related to a suppressor for a firearm.

BACKGROUND

The purpose of a firearm suppressor is to reduce the noise, muzzle flash and recoil caused by the propellant gases produced during the firing of the firearm and to improve shooting accuracy. A suppressor helps to conceal the location of the shooter, protect the hearing of the shooter or bystanders, and reduce the noise caused by the shooting.

A traditional thread-mounted firearm suppressor has, at the ends of its cylindrical outer casing, entry and exit openings for the bullet, and, within it, there are provided expansion chambers divided by baffles, in which propellant gases can expand and cool. Propellant gases transfer heat to the structures of the suppressor and are discharged from the suppressor via the exit opening and re-enter the firearm via the entry opening.

However, traditional suppressors have drawbacks related to their operation, such as loosening attachment, significant heating, and significant fouling of the firearm as propellant gases re-enter the interior parts of the firearm through the barrel, which causes malfunction.

A suppressor solution is disclosed in U.S. Pat. No. 10,393,463 in which additional openings are formed around the bullet exit opening in the suppressor to tighten the attachment of the suppressor to the threads of the barrel of the firearm, while the propellant gases deflected by the additional openings are allowed to flow more freely out of the suppressor. At the same time, the increased flow of propellant gas reduces the amount of propellant gas re-entering the interior of the firearm.

SUMMARY

An object of the invention is to solve the problems of known suppressor solutions and to provide a firearm suppressor with a simple, light, easy-to-manufacture and easy-to-clean construction, wherein the propellant gas is not stopped inside the suppressor but directed to flow in a controlled manner through the suppressor and out of the suppressor, thereby significantly reducing the heating of the suppressor, the fouling of the firearm by propellant gases and gunpowder firing residues, and the contact of the propellant gases with the shooter's face.

An object of the invention is achieved by a suppressor, a suppressing method, and a firearm according to the independent claims, and some embodiments of the invention are set out in those independent claims.

A suppressor for a firearm comprises a first end having a bullet entry opening, an outer casing, a baffle element having an opening for a bullet to pass through, a bullet channel for a bullet propagation, expansion chambers for cooling a propellant gas, and a second end having a bullet exit opening and at least one gas exhaust opening. The suppressor is adapted to direct the propellant gas discharged from the firearm out of the suppressor through at least one gas exhaust opening at at least the second end. The first end, the outer casing and the second end define expansion chambers so that a first expansion chamber is formed (established) between the first end and the baffle element, and the bullet channel and a second expansion chamber are formed between the baffle element and the second end. The baffle element is adapted to direct a portion of the propellant gas discharged from the firearm in the second expansion chamber onto an inner surface of the outer casing to cool it so that the cooled propellant gas can flow out of the suppressor via at least one exhaust opening and a bullet channel formed in connection with the exit opening.

A suppressing method for the above suppressor comprises a step of forming (establishing) the first expansion chamber for cooling the propellant gas and defined by the first end having the bullet entry opening, then outer casing, and the baffle element having the opening for the bullet to pass through. The method further comprises a step of forming the bullet channel for the propagation of the bullet and the second expansion chamber for cooling the propellant gas, defined by the baffle element, the outer casing, and the second end of the suppressor having the bullet exit opening and the at least one gas exhaust opening. The method further comprises a step of directing, by means of the baffle element, the portion of the propellant gas discharged from the firearm in the second expansion chamber onto the inner surface of the outer casing to cool the propellant gas so that the cooled propellant gas can flow out of the suppressor via at least one exhaust opening in the second end and a bullet channel formed in connection with the exit opening.

A firearm comprising a suppressor according to the above suppressor embodiment attached thereto.

BRIEF DESCRIPTION OF THE FIGURES

In the detailed description of the figures, exemplary embodiments of the invention are described in more detail with reference to the following figures.

DETAILED EXPLANATION OF THE FIGURES

Figure 1A:
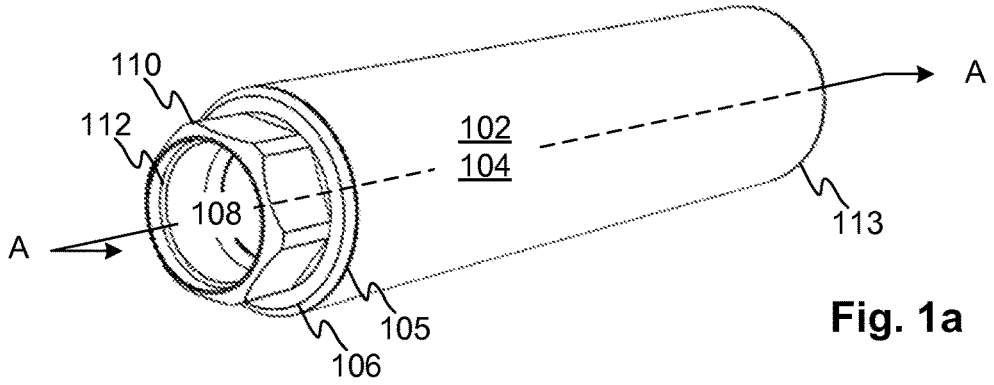
FIGS. 1*a*-1*c* show a suppressor for a firearm to be detachably attached to it in a diagonal front view, side view and diagonal rear view
Figure 1B:
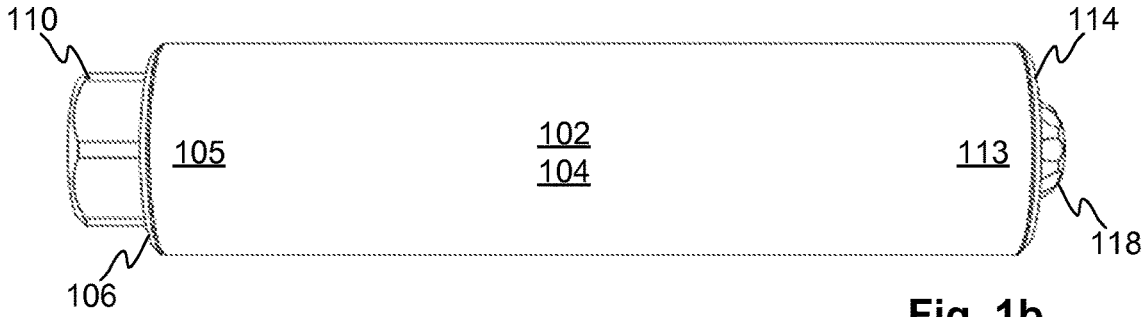
Figure 1C:
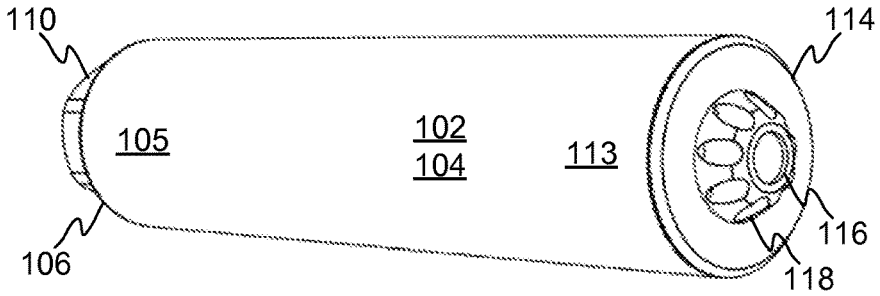

FIGS. 1*a*-1*c*, 2, 3*a*-3*c* and 4*a*-4*c* show a suppressor (silencer) 102 for a firearm (gun), such as a semi-automatic or fully automatic, gas-operated self-loading assault rifle, submachine gun or machine gun, or semi-automatic gas-operated self-loading rifle, submachine gun, or pistol, used to reduce the noise, muzzle flash, and recoil caused by the propellant gas arising from firing and to increase shooting accuracy.

The suppressor 102 comprises an outer casing 104, the shape of which is shown in the figures as a circular cylinder (right circular cylinder), but may be something other, such as a cylinder, a rectangular cuboid, or a prism.

The suppressor 102 further comprises a first entry end 106 formed in connection with the outer casing 104, the first edge 105 thereof, having a substantially centrally formed bullet entry opening 108 having an inside diameter dependent on the caliber of the firearm and smaller than the diameters of the inner surface 342 of the outer casing 104 and the inner surface 112 of the mounting part 110. A fastener (fastener part, mounting part) 110 may be formed on the end 106, by means of which the suppressor 102 can be detachably attached to the barrel of the firearm, to a muzzle brake attached to the barrel, or to a flash guard attached to the barrel. Hereinafter, when referring to the attachment of the suppressor 102 to the barrel, the reference includes the barrel of a firearm equipped with a muzzle brake or flash guard. Alternatively, and in contrast to the figures, the suppressor 102 may be an integral, i.e. fixed, part of the barrel of the firearm.

The fastener 110 may comprise threads (not shown) formed on its inner surface 112 that mate with threads on the outer surface of the barrel (muzzle brake, flash guard) of the firearm and allow the suppressor 102 to be screwed onto the barrel with the assistance of the user. Alternatively, the fastener 110 may comprise a quick release fastener (not shown) allowing quick attachment and release of the suppressor 102.

The suppressor 102 further comprises a second exit end 114 formed in connection with the outer casing 104, the second edge 113 thereof, having a substantially centrally formed bullet exit opening 116 having an inside diameter also dependent on the caliber of the firearm and not greater than the diameter of the inner surface 112 of the opening 108. In addition, at least one gas exhaust opening 118, e.g., one, two, three, or more exhaust openings 118, is formed in the vicinity of (around) the opening 116 at the end 114 to direct propellant gas discharged from the firearm and passing through the suppressor 102 out of the suppressor 102.

The suppressor 102 further comprises an expansion space 320, 322 defined by the end 106, the outer casing 104 and the end 114 for cooling the propellant gas, in which space the propellant gas tends to transfer the heat contained therein to the structures of the suppressor 102.

Figure 2:
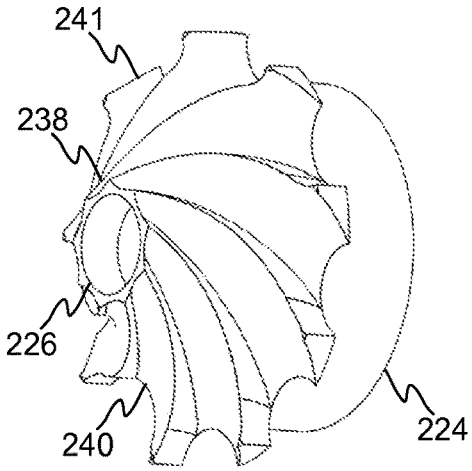
FIG. 2 shows details of the turbine construction of the baffle element

FIG. 2 shows a baffle element 224 comprised by the suppressor 102 in addition to the above, in which a bullet passageway 226 is centrally formed, the inner diameter of which substantially corresponds to the inner diameter of the opening 116. The baffle element 224 is mounted in the expansion space 320, 322 shown in more detail in the following figures between the ends 106, 114 so that its outer edge 241 rests against the inner surface 342 of the outer casing 104, whereby a first expansion chamber 320 for cooling the propellant gas is formed between the end 106 and the baffle element 224, and a second expansion chamber 322 for further cooling the propellant gas is formed between the baffle element 224 and the end 114.

The baffle element 224 is formed so that its surface structure 238 facing (toward) the first expansion chamber is a turbine-like surface structure having curved guide grooves (turbine grooves) 240 extending from, or from the proximity of, the opening 226 in the center of the baffle element 224 toward the outer edge 241 and extending up to the outer edge 241. The outer edge 241 is shaped so that at each groove 240 a flow gap 344 is formed between the outer edge 241 and the inner surface 342 of the outer casing 104, from which propellant gas can flow into the chamber 322.

The baffle element 224 is intended to direct (cause) at least a portion of the propellant gas discharged into the chamber 320 and impinging on the surface structure 238 to flow, in a circulatory flowing motion, by means of the grooves 240 (along the grooves 240) through the gaps 344 into the chamber 322 along the inner surface 342 of the outer casing 104 so as to form the longest possible flow path F for the propellant gas on the inner surface 342 of the outer casing 104 to enhance cooling.

The baffle element 224 is further intended to direct the propellant gas impinging on it into the grooves 240 of the surface structure 238, thereby producing a circulatory flow of propellant gas which in turn rotates the suppressor 102 relative to the barrel in its threads, if the fastener 110 comprises threads, thus preventing the suppressor 102 from loosening when the gun is fired.

The end 104 may be shaped as shown, with the barrel attached to the end of the suppressor 102 and the expansion space (chambers) 320, 322 in front of the barrel, or alternatively it may be shaped so that the first expansion chamber 320 partially overlies the outer surface of the barrel.

Figure 3A:
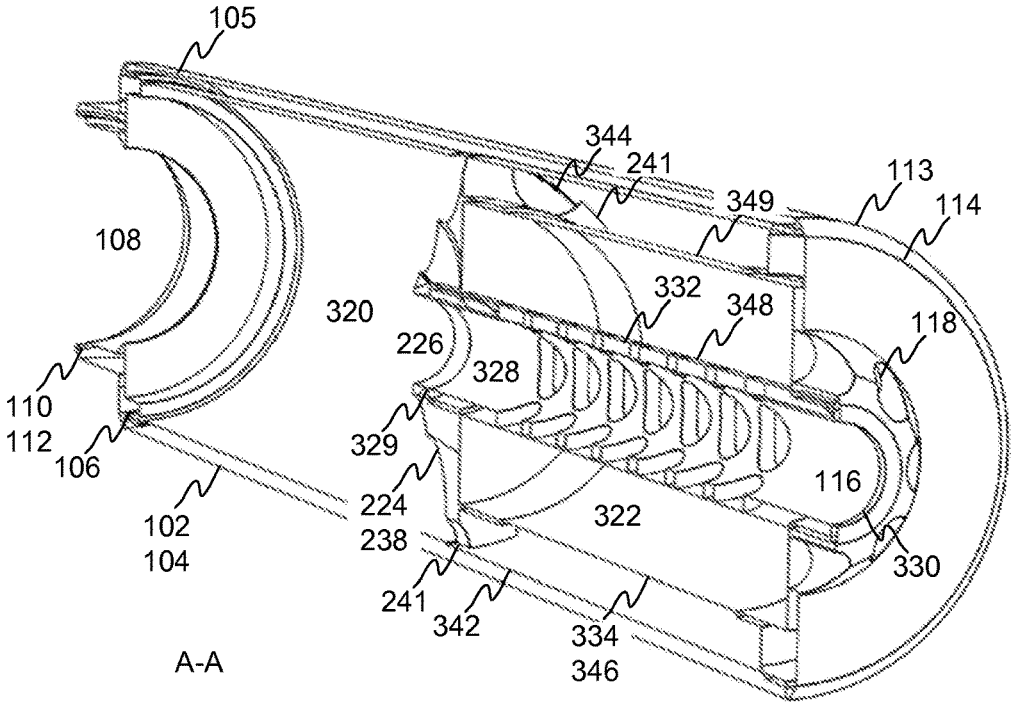
FIGS. 3*a*-3*c* show interior parts of a detachable suppressor for a firearm in cross section along the line A-A in a diagonal front view, side view and diagonal rear view
Figure 3B:
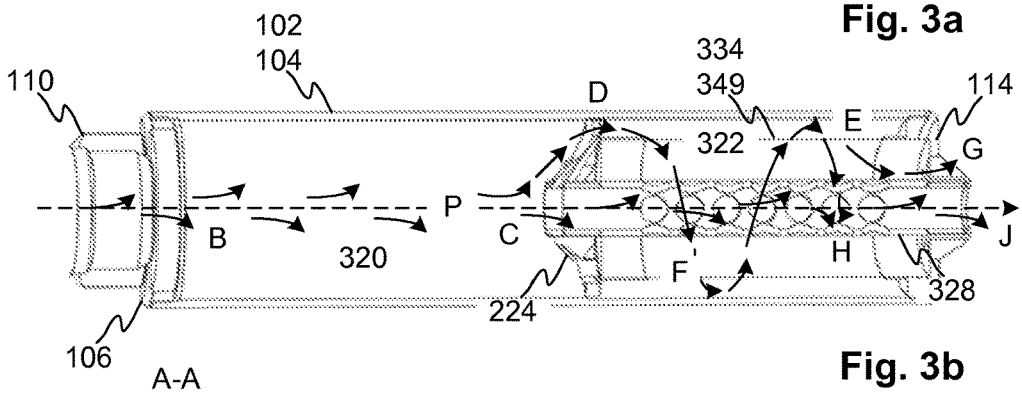
Figure 3C:
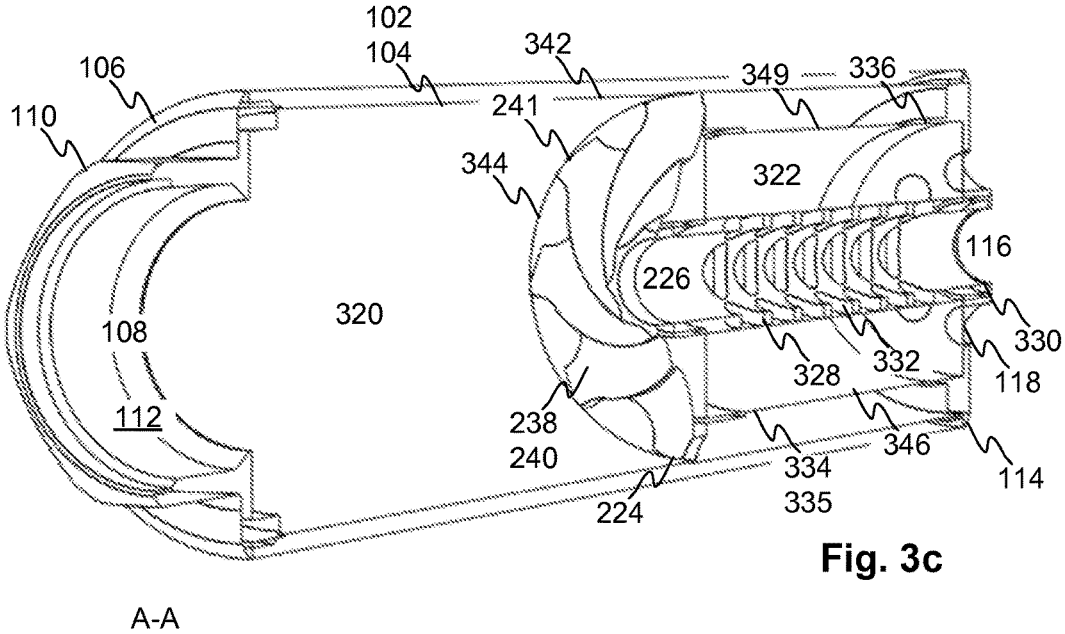

FIGS. 3*a*-3*c* show a bullet channel 328 of a cylindrical shell structure included in the suppressor 102 in addition to the above-mentioned, mounted in the chamber 322 between the baffle element 224 and end 114 having an inner diameter substantially equal to or greater than the inner diameters of the openings 226, 116. The bullet channel 328 is mounted so that its first edge 329 abuts the baffle element 224 and the second edge 330 abuts the end 114.

The bullet channel 328, together with the openings 108, 226, 116, forms a propagation path P for the bullet through the suppressor 102. At least one flow opening 332, e.g., one, two, three or more flow openings 332, is formed in the shell structure of the bullet channel 328. The purpose of the bullet channel 328 is also to direct a portion of the propellant gas impinging on its outer surface 348 from the direction of the inner surface 342 of the outer casing 104 out of the suppressor 102 through at least one opening 118 and let some of it pass through via at least one opening 332 so that propellant gas in the bullet channel 328 impinges on propellant gases trailing the bullet, preventing them from escaping without suppression out of the suppressor 102 through the bullet channel 328.

The baffle element 224 resting on the inner surface 342 of the outer casing 104 supports the bullet channel 328 so that it remains straight with respect to the bullet propagation path P when the suppressor 102 is used.

FIGS. 3*a*-3*c* show a cooling sheath 334 of a cylindrical shell structure included in the suppressor 102 in addition to the above-mentioned, mounted in the chamber 322 between the baffle element 224 and end 114 and between the bullet channel 328 and the outer casing 104 to further cool the propellant gas in chamber 322 after chamber 320. The diameter of the inner surface 346 of the cooling sheath 334 is larger than the diameter of the inner surface of the bullet channel 328 and smaller than the diameter of the inner surface 342 of the outer casing 104. The cooling sheath 334 is mounted so that its first edge 335 abuts the baffle element 224 and the second edge 336 abuts the end 114. The mounted cooling sheath 334 is secured with a mounting spring (not shown) so that the cooling sheath 334 remains in place by means of a mounting spring mounted around its outer surface 349.

The cooling sheath 334 is formed of a reticulated structure that allows propellant gas to flow through the cooling sheath while providing the largest possible cooling surface. Alternatively, the cooling sheath 334 may be formed of a porous, air-permeable filter structure which, like the reticulated structure, allows propellant gas to flow through and cool. With the porous filter structure, it is possible to reduce the weight of the suppressor 102 even more than the reticulated structure.

The purpose of the cooling sheath 334 is to allow cooled propellant gas flowing from the inner surface 342 of the outer casing 104 to pass through so that the cooling sheath 334 further cools the propellant gas as it flows inside the cooling sheath 334. Another purpose of the cooling sheath 334 is to direct the further cooled propellant gas from its outer surface 348 through at least one exhaust opening 118 out of the suppressor 102.

FIG. 3*b* shows how, when discharging a firearm with a suppressor 102 shown in the figures attached thereto, a bullet shoots out of the cartridge chamber and propagates, trailed by propellant gas, to the barrel of the firearm, where, as the bullet enters the chamber 320 through the opening 108, as depicted by reference B, a portion of propellant gas that moves faster than the bullet passes the bullet and discharges into the chamber 320 and impinges on the turbine-like surface structure 238 of the baffle element 224, as depicted by reference C.

The bullet continues to propagate along the propagation path P through the opening 226 of the baffle element 224, along the bullet channel 328 and from there through the opening 116 out of the firearm and suppressor 102.

The flow direction of propellant gas impinging on the baffle element 224 changes and it is guided along and by means of the grooves 240, through gaps 344 between the baffle element 224 and the outer casing 104, into the chamber 322, as depicted by reference D, and to the inner surface 342 of the outer casing 104, being forced into a high-velocity circulatory (rotating) flowing motion with the longest possible flow path F. The easily cooled, large cooling surface area of the outer casing 104 effectively cools propellant gas flowing against the inner surface 342 in the chamber 322 due to the centrifugal force produced by the high flow rate.

Propellant gas impinging on the baffle element 224 further tightens the suppressor 102 more tightly on the barrel threads as the propellant gas propagates along the grooves 240, thereby preventing the suppressor 102 from loosening during use.

As the velocity of the cooled propellant gas decreases, a portion of it impinges on the cooling sheath 334 in a substantially transverse direction, as depicted by reference E, whereby, as the propellant gas propagates through the reticulated structure of the cooling sheath 334 with a large cooling area, its propagation distance in the reticulated structure is as long as possible, whereby the propellant gas cools and its velocity continues to decrease as the propellant gas impinges on the reticulated structure and has to get round the reticulated structures.

A portion of the propellant gas that has passed through the cooling sheath 334 is directed from its inner surface 346 and the outer surface 348 of the bullet channel 328 toward the end 114 in the space between the cooling sheath 334 and the bullet channel 328 and via the at least one opening 118 of the end 114 out of the suppressor 102, as depicted by reference G. Another portion of the propellant gas is directed into the bullet channel 328 through its at least one opening 332, impinging, as depicted by reference H, at a substantially perpendicular angle on the propellant gas trailing the bullet, slowing down its flow rate so that the propellant gas trailing the bullet cannot be discharged at high speed without suppression, but instead exits suppressed through the opening 116 of the bullet channel 328 out of the suppressor 102 as depicted by reference J.

Figure 4A:
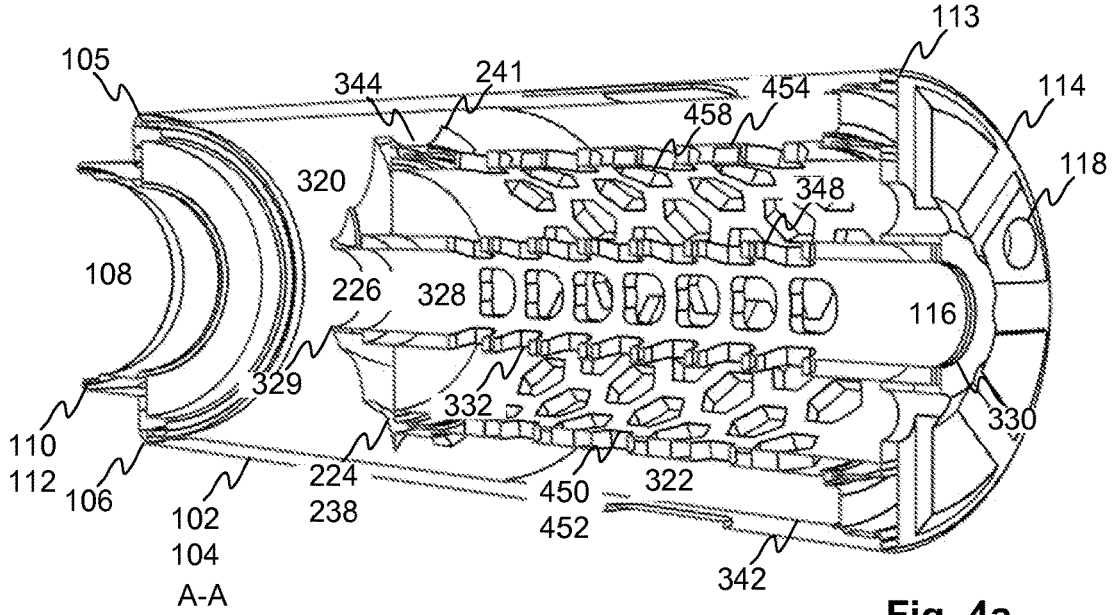
FIGS. 4*a*-4*c* show interior parts of a suppressor according to the above figure having a mounting sheath for a cooling sheath, in cross section along the line A-A in a diagonal front view, side view and diagonal rear view.
Figure 4B:
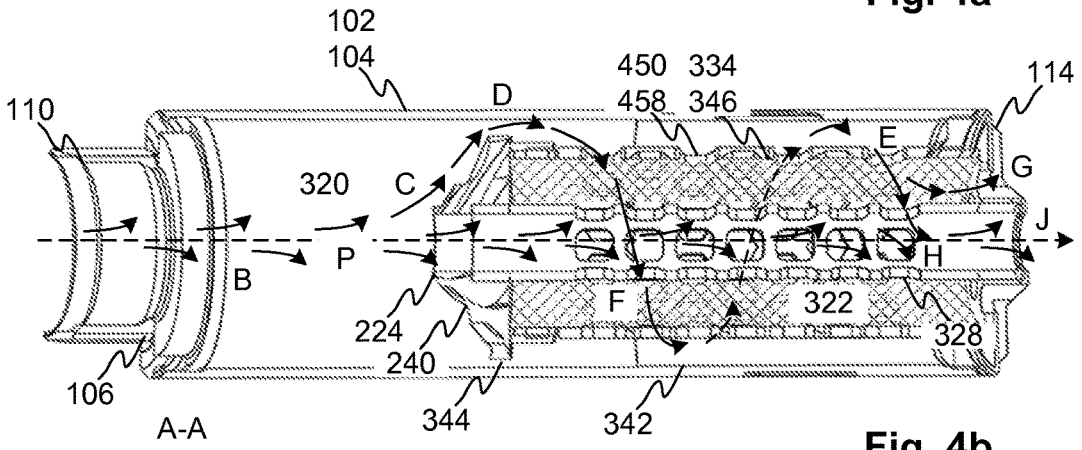
Figure 4C:
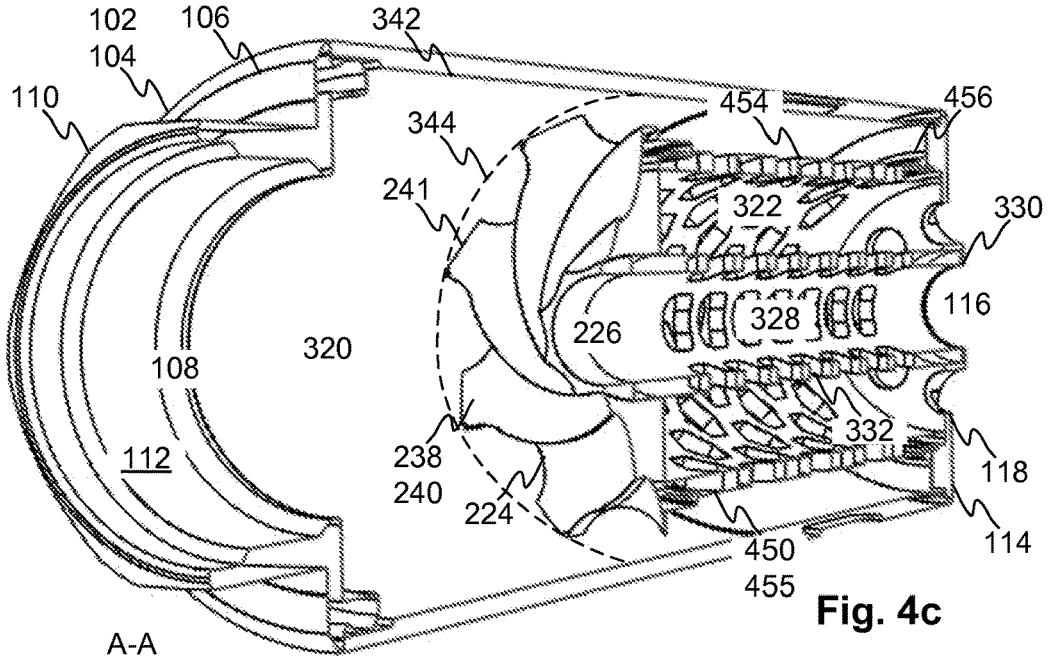

FIGS. 4*a*-4*c* show a suppressor 102 corresponding in structure and function to the suppressor 102 of the previous figures, with the exception that the cooling element 334 is attached, instead of a mounting spring, by means of a threaded mounting sheath 450.

The purpose of the mounting sheath 450, like that of the alternative, the mounting spring, is to hold the cooling sheath 334 in place so that the cooling element 334 cannot move. When the gun is fired, especially in the automatic firing mode, the mounting sheath 450 and the mounting spring hold the cooling sheath 334 heated by propellant gases in place.

The mounting sheath 450 is installed in the chamber 322, between the baffle element 224 and the end 114, in such a way that the mounting sheath 450 consisting of a cylindrical (right circular cylindrical) shell structure rests (is mounted) on the cooling element 334, against (facing) the outer surface 349 thereof. The diameter of the mounting sheath 450 (inner surface 452) is larger than the diameter of the cooling element 334 (outer surface 349) and its diameter (outer surface 454) is smaller than the diameter of the inner surface 342 of the outer casing 104 so as to fit between the cooling element 334 and the outer casing 104.

Threads (not shown) have been formed at both ends 455, 456 of the mounting sheath 450 so that the mounting sheath 450 can be secured in place by screwing it onto threads (not shown) formed in the baffle element 224 structure facing the chamber 322 and onto threads (not shown) formed in the end 114 structure facing the chamber 322. The mounting sheath 450 is installed on the cooling sheath 334 (not shown in FIGS. 4*a* and 4*c*) so that its first end 455 abuts the baffle element 224, the second end 456 abuts the end 114, and the inner surface 452 faces the cooling sheath 334 (outer surface 349).

At least one flow opening 458, e.g., one, two, three or more flow openings 458, has been formed in the mounting sheath 450. The at least one flow opening 458 is has a shape which is e.g. circular, square, elliptic, rectangular, or, as shown, a polygon, such as a pentagon, hexagon, heptagon, or a polygon having more sides.

The purpose of the mounting sheath 450 is also to direct (let) the cooled propellant gas impinging on its outer surface 454 from the direction of the inner surface 342 of the outer casing 104 via at least one opening 458 through the mounting sheath 450 so that the propellant gas can pass to the cooling sheath 334 for additional cooling and be directed therethrough in order to discharge the cooled propellant gas through the opening 116 of the bullet channel 328 and at least one exhaust opening 118 out of the suppressor 102 as shown in FIG. 3*b*.

FIG. 4*b* illustrates how the bullet and propellant gas propagate and the propellant gas is suppressed in a manner corresponding to that shown in connection with the previous figures when a firearm provided with a suppressor 102 having a mounting sheath 450 is discharged.

After leaving the cartridge chamber, the bullet advances in the barrel of the firearm, trailed by propellant gas, and enters the suppressor 102 and the chamber 320 from the opening 108, as depicted by reference B. A portion of the propellant gas bypasses the bullet in the chamber 320, impinging on the turbine-like surface structure 238 of the baffle element 224, as depicted by reference C. The bullet continues to propagate along the propagation path P through the opening 226 of the baffle element 224 into the bullet channel 328 and from there through the opening 116 of the end 114 out of the firearm and suppressor 102.

Propellant gas impinging on the baffle element 224 is guided, as depicted by reference D, along the grooves 240, through gaps 344, into the chamber 322 and to the inner surface 342 of the outer casing 104, being forced into a high-velocity circulatory flow along flow path F. The outer casing 104 effectively cools propellant gas flowing against the inner surface 342 in the chamber 322.

Propellant gas impinging on the baffle element 224 tightens the suppressor 102 more tightly on the barrel threads and, at the same time, the mounting sheath 450 on the threads of the baffle element 224 and end 114 as the propellant gas travels along the grooves 240, thereby preventing loosening of the attachments of both the entire suppressor 102 and its internal structures 114, 224, 238, 334 and 450 during use.

The cooled propellant gas, as its velocity decreases, impinges on the mounting sheath 450, passing through it via at least one flow opening 458, as depicted by reference E. Propellant gas that has passed through the mounting sheath 450 impinges on the cooling sheath 334 (outer surface 349) in a substantially transverse direction and propagates through the structure of the cooling sheath 334, slowing down and continuing to cool at the same time.

A portion of the propellant gas that has passed through the cooling sheath 334 is directed from its inner surface 346 and the outer surface 348 of the bullet channel 328, in the space between the cooling sheath 334 and the bullet channel 328, toward the end 114 and, there, via at least one opening 118 out of the suppressor 102, as depicted by reference G. Another portion of the propellant gas is directed via at least one opening 332 into the bullet channel 328 impinging, as depicted by reference H, on propellant gas trailing the bullet, suppressing it. Suppressed propellant gas is discharged from the suppressor 102 through the opening 116 of the bullet channel 328, as depicted by reference J.

The suppressor 102, which has a simple detachably assembled construction consisting of components 104, 106, 114, 224, 328, 334, 450, is made of e.g. stainless steel, aluminum, titanium or nickel-chromium-based alloy, such as INCONEL® alloy.

Thanks to the operating principle enabled by the construction of the suppressor 102, the propellant gas does not stop within the suppressor 102 but continues to flow while cooling rapidly, whereby the volume of the propellant gas decreases before being controllably discharged from the suppressor 102 through openings 116, 118.

The inner structure of the suppressor 102 according to the images, in particular of the inner structure formed by components 114, 224, 238, 334, 450, is hold in place by the threaded fastening mechanism formed at the ends 455, 456 of the mounting sheath 450 without welding or soldering. The threads are designed so that they are tightened, as is the entire suppressor 102, when shooting, so that the inner structure 114, 224, 238, 334, 450 remains even more solidly together.

The inner structure of the suppressor also enables its easy disassembly and assembly, which in turn facilitates the maintenance of the suppressor 102, i.e., cleaning and, where appropriate, replacement of a broken part, such as at least one of the parts 114, 224, 238, 334, 450.

The suppressor 102 can be used with different caliber firearms by replacing the inner components 114, 224, 238 of the suppressor so that the opening 226 of the baffle element 224, the inner diameter of the bullet channel 238 and the opening 116 of the end 114 correspond to the caliber of the firearm used.

Due to the structure of the suppressor 102, no propellant gas and discharge residue re-enter the firearm from the suppressor 102, thereby significantly reducing the fouling of the firearm and resulting malfunction. In addition, malfunction caused by the increased amount of gas due to the propellant gas and the heating of the firearm caused by the propellant gas are significantly reduced. In addition, the amount of propellant gas discharged on the shooter's face is reduced. Due to the above advantages, maintenance of the firearm is easier, reliability improves, and the shooter can better maintain their ability to function.

Only some exemplary embodiments of the invention have been described above. Naturally, the principle according to the invention can be modified within the scope of protection defined by the claims, e.g. with regard to implementation details and fields of application.

The invention claimed is:

1. A suppressor for a firearm, comprising
a first end comprising a bullet entry opening,
an outer casing,
a baffle element comprising a bullet passageway,
a bullet channel for a propagation of a bullet,
expansion chambers for a cooling of gas, and
a second end comprising a bullet exit opening and at least one gas exhaust opening,
which suppressor is adapted to direct a propellant gas discharged from the firearm out of the suppressor through the at least one gas exhaust opening at least the second end, and
which first end, outer casing, and second end define the expansion chambers so that a first expansion chamber is formed between the first end and the baffle element, and the bullet channel and a second expansion chamber are formed between the baffle element and the second end,
wherein the baffle element is adapted to direct, through a space between the baffle element and outer casing, a portion of the propellant gas discharged from the firearm into the second expansion chamber, onto an inner surface of the outer casing to cool the propellant gas so that the cooled propellant gas can flow out of the suppressor via the at least one exhaust opening and the bullet channel in connection with the exit opening, and
wherein a surface structure of the baffle element facing the first expansion chamber is a turbine-like surface structure, which is adapted to cause at least the portion of the propellant gas discharged into the first expansion chamber and impinging on the surface structure to move along the inner surface of the outer casing in a circulatory flowing motion to enhance cooling in the second expansion chamber.

2. The suppressor according to claim 1, further comprising a cooling sheath in the second expansion chamber between the bullet channel and the outer casing, which is adapted to allow the cooled propellant gas from the inner surface of the outer casing to pass so that the cooling sheath further cools the propellant gas as it flows inside the cooling sheath.

3. The suppressor according to claim 2, wherein the cooling sheath is formed of a reticulated structure to provide a largest possible cooling surface.

4. The suppressor according to claim 2, wherein at least one of the inner surface of the cooling sheath and the outer surface of the bullet channel is adapted to direct a portion of the further cooled propellant gas out of the suppressor through the at least one exhaust opening.

5. The suppressor according to claim 2, wherein the cooling sheath is formed of a cylindrical structure.

6. The suppressor according to claim 2, wherein a mounting sheath, which attaches to the baffle element and the second end, is provided between the inner surface of the outer casing and the outer surface of the cooling sheath, which mounting sheath is adapted to hold the cooling element in place and allow the propellant gas to pass through onto the cooling sheath.

7. The suppressor according to claim 1, wherein the bullet channel is adapted to allow at least a portion of the cooled propellant gas from the inner surface of the outer casing to pass through so that the cooled propellant gas entering the bullet channel impinges on a propellant gas trailing the bullet, preventing it from escaping out of the suppressor without suppression through the bullet channel.

8. The suppressor according to claim 7, wherein the bullet channel formed of a cylindrical structure has at least one flow opening adapted to allow the further cooled propellant gas, which has entered a cooling sheath, to flow into the bullet channel.

9. The suppressor according to claim 1, wherein the turbine-like surface structure is adapted to cause at least the portion of the propellant gas to move along the inner surface of the outer casing in the circulatory flowing motion, forming a longest possible flow path for the propellant gas on the inner surface of the outer casing.

10. The suppressor according to claim 1, wherein flow gaps have been formed between an outer edge of the baffle element and the inner surface of the outer casing by means of which the baffle element is adapted to direct the propellant gas from the first chamber to the second chamber into a flowing motion circulating along the inner surface of the outer casing.

11. The suppressor according to claim 10, wherein a turbine-like surface structure of the baffle element facing the first expansion chamber is formed by guide grooves extending from the vicinity of the passageway opening to the outer edge of the baffle element so that a flow gap is formed at each guide groove between the outer edge of the baffle element and the inner surface of the outer casing, from where the propellant gas can flow into the second chamber.

12. The suppressor according to claim 1, wherein a fastener is formed at the first end, by means of which the suppressor is releasably attached directly to a barrel of the firearm or attached to the barrel through a muzzle brake or flash guard of the firearm.

13. The suppressor according to claim 12, wherein the fastener has threads adapted to rotate into the threads of the barrel of the firearm as the suppressor rotates relative to the barrel when turned by the user or by means of a circulatory flowing motion of the propellant gas caused by a surface structure of the baffle element.

14. A suppression method for a firearm, comprising:

providing a suppressor comprising:

a first end comprising a bullet entry opening, an outer casing, a baffle element comprising a bullet passageway, a bullet channel for a propagation of a bullet, expansion chambers for a cooling of gas, and a second end comprising a bullet exit opening and at least one gas exhaust opening, which suppressor is adapted to direct a propellant gas discharged from the firearm out of the suppressor through the at least one gas exhaust opening at least the second end;

forming a first expansion chamber for cooling the propellant gas and defined by the first end of the suppressor having the bullet entry opening, the outer casing, and the baffle element having the opening for the bullet to pass through, forming the bullet channel for the propagation of the bullet and a second expansion chamber for cooling the propellant gas, defined by the baffle element, outer casing, and the second end of the suppressor having the bullet exit opening and the at least one gas exhaust opening, and directing, by the baffle element, through the space between the baffle element and outer casing, the portion of the propellant gas discharged from the firearm into the second expansion chamber and onto an inner surface of the outer casing to cool the propellant gas so that the cooled propellant gas can flow out of the suppressor via the at least one exhaust opening of the second end and the bullet channel in connection with the exit opening, wherein a surface structure of the baffle element facing the first expansion chamber is a turbine-like surface structure, which causes at least the portion of the propellant gas discharged into the first expansion chamber and impinging on the surface structure to move along the inner surface of the outer casing in a circulatory flowing motion to enhance cooling in the second expansion chamber.

15. The firearm comprising the attached suppressor according to claim 1.

* * * * *